US006725751B1

(12) United States Patent
Surina

(10) Patent No.: US 6,725,751 B1
(45) Date of Patent: Apr. 27, 2004

(54) ROTARY PUNCHING APPARATUS

(75) Inventor: Michael Surina, Waterdown (CA)

(73) Assignee: Formtek, Inc., Westfield, MA (US)

( * ) Notice: Subject to any disclaimer, the term of this patent is extended or adjusted under 35 U.S.C. 154(b) by 10 days.

(21) Appl. No.: 09/706,923

(22) Filed: Nov. 6, 2000

(30) Foreign Application Priority Data

Nov. 5, 1999 (CA) ..... 2288561

(51) Int. Cl.[7] ..... B26D 3/00; B26D 5/08; B26F 1/14

(52) U.S. Cl. ..... 83/49; 83/622; 83/670; 83/687; 83/691

(58) Field of Search ..... 83/49, 337, 304, 83/305, 622, 669, 670, 687, 691

(56) References Cited

U.S. PATENT DOCUMENTS

| | | | | | |
|---|---|---|---|---|---|
| 1 | A | * | 7/1836 | Ruggles | 16/100 |
| 1,189,093 | A | * | 6/1916 | Gompf | 144/196 |
| 1,948,139 | A | | 2/1934 | Smitmans | 164/68 |
| 1,965,523 | A | | 7/1934 | MacFarren | 164/68 |
| 2,018,366 | A | * | 10/1935 | Klause | 76/107.1 |
| 2,083,370 | A | * | 6/1937 | Greulich | 72/186 |
| 2,233,000 | A | * | 2/1941 | Chesley | 83/49 |
| 2,445,174 | A | | 7/1948 | Hannewald et al. | 164/66 |
| 2,469,526 | A | | 5/1949 | Sloat | 101/226 |
| 2,491,871 | A | | 12/1949 | Morgan | 164/66 |
| 2,989,228 | A | * | 6/1961 | Glattli | 234/122 |
| 3,143,022 | A | * | 8/1964 | Anderson | 83/670 |
| 3,209,630 | A | * | 10/1965 | McCartan | 83/670 |
| 3,222,966 | A | * | 12/1965 | Tornberg et al. | 83/436.75 |
| 3,247,744 | A | | 4/1966 | Huck et al. | 83/107 |
| 3,257,885 | A | * | 6/1966 | Hornung | 83/669 |
| 3,260,159 | A | * | 7/1966 | Dovey | 83/669 |
| 3,606,813 | A | | 9/1971 | Hallden | 83/672 |
| 3,641,858 | A | | 2/1972 | Tuschy et al. | 83/337 |
| 3,657,954 | A | * | 4/1972 | Wilkins | 83/345 |
| 3,827,321 | A | * | 8/1974 | Bley | 83/670 |
| 3,949,653 | A | * | 4/1976 | Schroter | 225/103 |
| 4,034,635 | A | | 7/1977 | Woolston | 83/38 |
| 4,273,015 | A | * | 6/1981 | Johnson | 83/345 |
| 4,343,215 | A | * | 8/1982 | Fuchs | 83/670 |
| 4,380,943 | A | | 4/1983 | Evans | 83/38 |
| 4,499,802 | A | * | 2/1985 | Simpson | 83/117 |
| 4,512,225 | A | | 4/1985 | Green | 83/38 |
| 4,685,318 | A | | 8/1987 | Ueda et al. | 72/185 |
| 4,816,105 | A | * | 3/1989 | Yamashita | 156/250 |
| 5,042,344 | A | | 8/1991 | Colombo | 83/343 |
| 5,207,138 | A | | 5/1993 | Sato et al. | 83/337 |
| 5,327,804 | A | * | 7/1994 | Creaden | 83/305 |

(List continued on next page.)

FOREIGN PATENT DOCUMENTS

| | | |
|---|---|---|
| GB | 678029 | 8/1952 |
| GB | 1107878 | 4/1965 |

*Primary Examiner*—Allan N. Shoap
*Assistant Examiner*—Jason Prone
(74) *Attorney, Agent, or Firm*—McCormick, Paulding & Huber LLP

(57) ABSTRACT

A rotary punching apparatus for punching openings in a moving web workpiece the openings having a predetermined length along the longitudinal axis of the web and having a pair of die assemblies located on opposite sides of the path of the web and a drive for rotating the assemblies, a leading die mounted on one assembly, and being moveable for generally radially so as to punch a die opening through the web, a mating die recess punched in the other of the assemblies; and, a trailing die adjacent to the leading die, being located to punch the web at a point adjacent the punched die opening so as to punch a second die opening in the web, the first die opening and the trailing die opening together defining a continuous opening having a predetermined length along the web. Also disclosed is a method of rotary punching by use of such apparatus.

21 Claims, 10 Drawing Sheets

U.S. PATENT DOCUMENTS 5,421,227 A 6/1995 Rohrdanz et al. ..... 83/38
5,437,758 A * 8/1995 Walsh, Jr. ..... 83/691
5,713,256 A 2/1998 Keeny ..... 83/26
5,911,414 A * 6/1999 Kato et al. ..... 234/38
5,937,719 A * 8/1999 Davis et al. ..... 83/305
5,962,040 A * 10/1999 Dais et al. ..... 83/669
6,205,898 B1 * 3/2001 Surina ..... 83/286
6,354,180 B1 * 3/2002 Hill ..... 83/669
6,378,409 B1 * 4/2002 Reid et al. ..... 83/304

* cited by examiner

ROTARY PUNCHING APPARATUS

FIELD OF THE INVENTION

The invention relates to a rotary punch apparatus for punching or piercing openings in moving web sheet material, and in particular for punched openings having significant length along the longitudinal axis of the moving web.

BACKGROUND OF THE INVENTION

Making openings by punching into a moving web has been carried on for many years. Where the openings were relatively small, i.e., short along the longitudinal axis of the moving web, then simple rotary dies could be used satisfactorily, in many cases. However, where the openings were elongated or had significant length along the longitudinal axis of the moving web, a simple rotary die, or dies carried on a rotating drum or roll, could not be used. In this case the industry has used so-called flying dies. These were dies which were mounted on carriage moveable along linear rails. The carriages were movable in a straight line intermittently to and fro along the longitudinal axis of the moving web. The carriages would accelerate from a stationary position and reach the linear speed of the moving web. At this point the carriages would move towards one another, closing the dies on the web, and thereby punching or piercing the opening while the dies were moving longitudinally, with the web. The dies would then open, and the carriage would move back along the rails to the start position. This system required the use of relatively expensive equipment, and the control of the carriage required sophisticated computer controls. These were needed to ensure that the carriage reached a speed matching the speed of the moving web, and that the dies closed at exactly the right moment to make the opening at the precise point required. Another more serious problem was the fact that stopping the carriage and reversing it, and then restarting it once more to accelerate for the next opening, required a measurable length of time. During this time no openings could be made in the web. If the design of the web product called for openings at closely spaced intervals, then there were one of two solutions:

Either the web had to be slowed down so that its speed was slow enough to give the die carriage time to return to its start position, and then start its next acceleration, or The line would be built with two or more such flying die carriages, mounted in tandem and operating in sequence.

Either solution was in practice expensive and unacceptable. Slowing down the web reduced the production volume per shift, and thereby increased product cost. Installing two or more flying die carriages was both expensive, and required even more sophisticated controls to ensure that the openings were in the right locations in the moving web.

The sheet metal industry, in particular, requires the production of web products having openings at relatively close spacings, and these openings have significant length along the longitudinal axis of the web. For example one sheet metal web product which is widely used is a so-called dry wall stud. This is a generally C-shaped channel, made of web sheet metal, which is used in erecting walls and partitions, usually interior partitions, in all kinds of office, commercial and industrial buildings. The market for this product, in particular, is highly competitive and manufacturers are constantly looking for ways to reduce their costs, and maintain market share. Such dry wall studs are made with relatively large or elongate openings at closely spaced intervals. These openings are required in construction to permit plumbing and electrical and other services to pass along the interior of the walls.

This is merely one example of a typical product which may be made from a continuously moving web. Numerous other products may be made from such a moving web. The web may be metallic or non metallic. The end product may be a web product with openings, or, in other cases the end product may be the portions of the web which are punched out from the web.

Clearly there is a need for a punching or piercing apparatus which can punch or pierce out relatively large or elongate openings from a moving web without the problems described above in connection with flying dies and moving carriages. Preferably, such an apparatus will be based on a rotary drum or roll, on which dies are mounted so that openings may be punched out or pierced, referred to herein as "punched", at desired intervals and as close as may be required, without delaying production or causing extra expense. Relatively simple controls will be provided to ensure that the rotary dies, or rolls carrying the dies, are operated in timed relation to the movement of the web along the production line, and that when no openings are required the rolls are inactive and the web can pass between the rolls without openings being punched. Openings having "significant" length along the web axis are referred to herein as "elongate openings" whether round, rectangular or any other shape. "Elongate openings" also includes objects or pieces which are stamped out of a web.

BRIEF SUMMARY OF THE INVENTION

With a view to achieving the foregoing objectives the invention comprises a rotary punching apparatus for punching openings in a moving web workpiece the openings having a significant length along the longitudinal axis of the web and having a pair of rolls located on opposite sides of the path of the web workpiece, and power means for rotating the rolls and having at least a leading die mounted on one said roll of said pair, and movement means for moving said die generally outwardly relative to said roll so as to punch a leading die opening through said web, said leading die opening defining a leading edge and a trailing web portion, and there being a mating leading die recess in the other of said rolls, and further having a second die adjacent to said first die, said second die being located to engage and punch the web at a point adjacent the web portion trailing portion of the leading die opening whereby to punch a continuation of said leading die opening in said web, said first die opening thereby defining a continuous opening having significant length along said longitudinal axis of said web and defining a trailing edge remote from said leading edge.

The invention preferably provides that a median die is fastened relative to said roll between the leading and trailing dies so that it does not move outwardly, and in this way acts to continue and to extend the leading die opening.

In a particularly advantageous embodiment, the invention provides a trailing die being moveable whereby to punch said web and define a trailing edge of said opening.

The invention may also provide at least a hole punch die moveable outwardly relative to said roll operable to punch a further opening in the web spaced axially along the longitudinal axis of the web from the said elongate opening punched by the leading and trailing dies.

The invention preferably provides power operated means for rotating the rolls, the power operated means being operable intermittently so as to punch the openings at desired longitudinal spacings along the axis of the web, the rolls being held inactive where openings are not required so as to permit the web to pass between them without openings being punched. The power operated means may be an intermittently operable motor, or may include a clutch so that the motor can operate continuously, and the clutch being operable to deliver rotary power to the rolls when required.

The invention may be built as rolls which extend across the width of the web and being rotatably mounted on bearings on either side edge of the web.

In a preferred case the rolls are mounted on a single stand in a cantilever fashion located along one side edge only of the web path, the rolls being long enough to extend partly across the web to locate the dies along the desired axis of the web.

The invention provides die operating means such as of cam means. The leading dies are mounted on supports extending into the roll and terminating in followers located to be engaged by the cam means. The trailing and hole punch dies are similarly mounted and engaged by cam means.

The invention provides die recesses in the other of the rolls registering with their respective dies and receiving portions of the web which are punched out. Knock out means are preferably provided to eject the punched out web portions from the recesses.

The various features of novelty which characterize the invention are pointed out with more particularity in the claims annexed to and a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

FIG. 4 is a perspective illustration of a finished article, in this case a piece of structural steel, such as is used for supporting drywall and the like;

DETAILED DESCRIPTION OF THE PREFERRED EMBODIMENT

Figure 1:
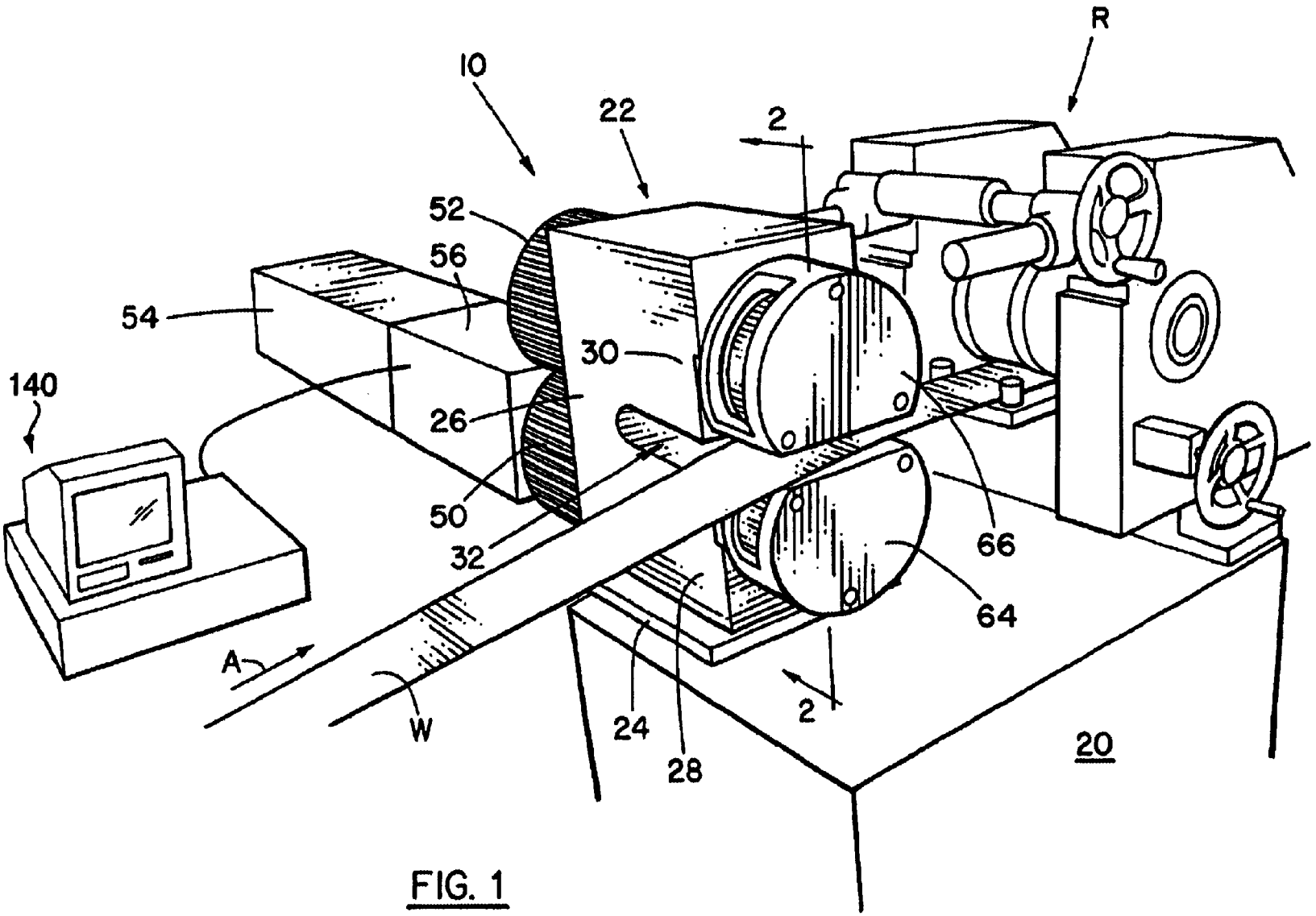
FIG. 1 is a general perspective of a rotary apparatus for punching openings in a moving web workpiece illustrating the invention, and showing the web in phantom with openings punched downstream of the apparatus.

Referring first of all to FIG. 1 it will be seen that the invention is there illustrated as a rotary punching apparatus indicated generally as 10. A web workpiece W is illustrated in phantom. The web moves continuously in the direction of the arrow A from an upstream location to a downstream location. Such a web may be a length of sheet metal strip, which will typically be unrolled from a coil, supported by means (not shown) located upstream which are well known in the art. The strip will be made into any desired shape usually by roll forming dies again well known in the art. In this particular case, the roll forming dies are located downstream of the apparatus 10, but this is not a prerequisite of the invention. The apparatus 10 could easily be engineered to be located downstream of the roller dies, in the case of many sheet products, if that was desired.

The web may be, at the location of the apparatus 10, a continuous strip which will eventually be cut into appropriate lengths somewhere down stream by suitable cut off die means.

In a preferred case, however, the cut off die means is located closely adjacent (upstream or downstream) to the rotary piercing apparatus 10 (the cut off die means being not shown) so that the web may be cut to appropriate lengths where it is still flat, either just before or just after the piercing of the openings in the manner described below.

In this case, where the web is cut while it is still flat, the individual web lengths will be formed in the roller dies (not shown) into the appropriate shapes, in this particular embodiment. Clearly in other embodiments there may be no roller dies at all. This may well be the case where, for example, the end product is the cut out portions from the web or where indeed the end product of the web is itself flat.

Figure 3:
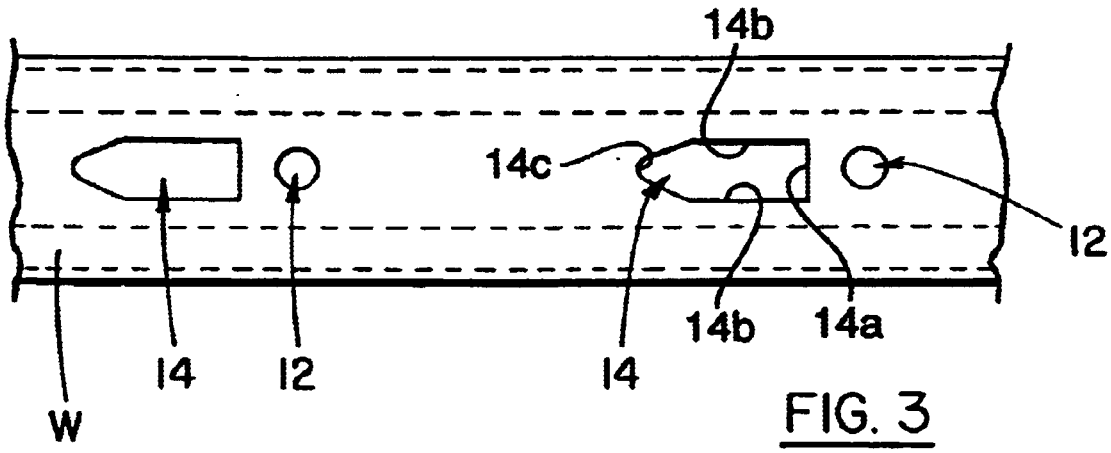
FIG. 3 is a top plan view of a portion of the web workpiece shown with short holes and elongate holes punched therein.
Figure 4:
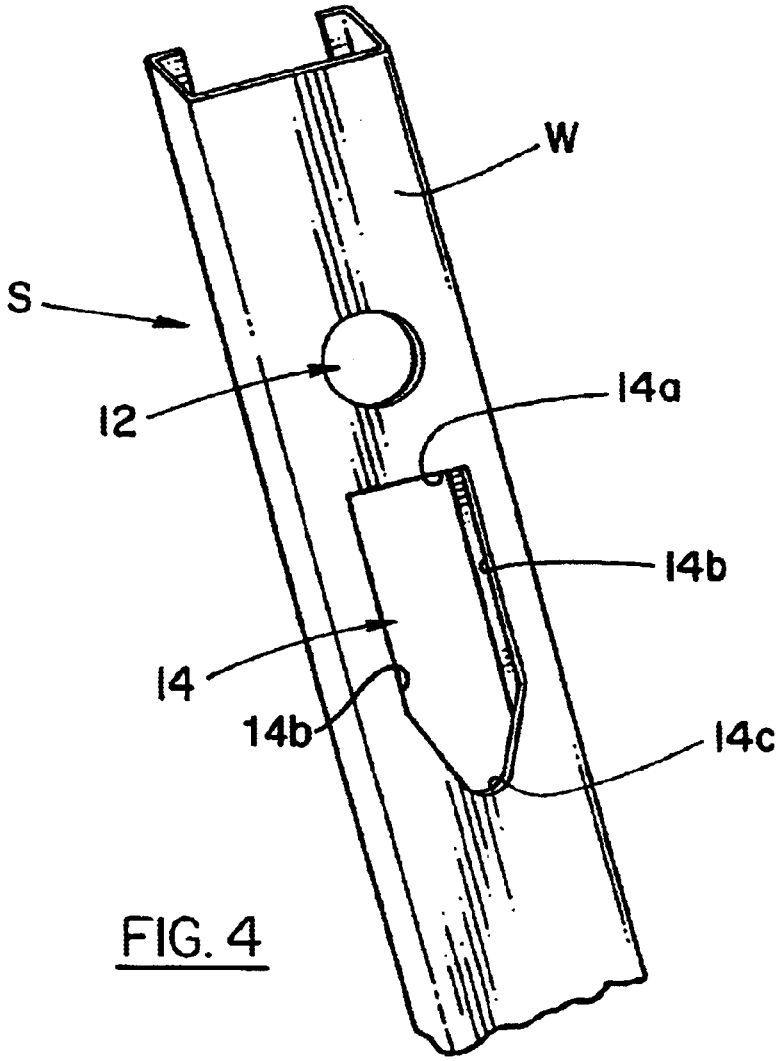

The invention is illustrated in conjunction with the punching of shorter openings 12 and longer or elongate openings 14. The long and short openings are located in pairs, in the case of the particular product illustrated. In this case the product shown, purely for the purposes of explanation, will eventually make a sheet metal dry wall stud. Such studs are known per se, FIG. 4 is a typical illustration. They are usually of rectangular C-shaped channel in cross section, usually having edge flanges turned over along the two sides of the edges of the stud. In accordance with industry practice the studs S are required to have short openings 12 and long openings 14 spaced apart along the longitudinal axis of the studs, as generally illustrated in FIGS. 3 and 4. These openings permit services such as plumbing and electrical services to passed along within the wall, as is well known in the industry.

The short openings 12, usually circular openings, are punched with single punch dies. The long or elongate openings 14 have significant length along the longitudinal axis of the web. It is these openings which cause the problems described above and the invention is particularly directed to the high speed rotary punching of such openings having significant length. Advantageously, the invention also punches both the short openings and the elongate openings having significant length, in sequence on the same rotary apparatus, in the manner to be described below.

However, in some cases it might conceivably occur that it was desirable to punch the short openings at a separate pair of rolls, by more conventional apparatus.

It will of course be appreciated that the formation of the longitudinal bends to form a C-shaped channel (FIG. 4), will usually take place down stream from the rotary apparatus 10 in roll forming apparatus R in the illustrated example as described above. The formation of such longitudinal rectangular C-shaped bends will be carried out using conventional roll forming dies such as are well known in the art and require no description or illustration.

It will also be appreciated that while the invention is illustrated as being used in this particular case in the process of making dry wall studs, the invention is of much wider application. The invention may be used in any situation where openings are required to be pierced through a moving web at precisely spaced longitudinal intervals. Alternatively, the invention may be employed where it is desired to stamp out portions of work pieces of a particular shape from a moving web. In this case, the stamped or pierced portions from the end product.

The web material may typically be sheet metal but in other cases may be a variety of other materials which may require to be punched pierced or stamped out in this way, at high speed and with great precision from a moving web.

Referring once again to FIG. 1, the apparatus 10 will be seen to comprise a base 20 which may be part of a continuous production line, but is merely illustrated here separately for the sake of explanation. Mounted on the base 20 is a machine body 22. The body 22 is an integral solid block of metal, in this embodiment. Body 22 defines a lower mounting plate 24, a generally upright side portion 26, a lower cantilever transverse support 28 and an upper cantilever transverse support 30.

Between the supports 28 and 30, a generally elongated space 32 is defined. The web W extends into the space 32, so that the web can move continuously between the lower and upper supports 28 and 30, in a manner described below.

As mentioned, all of plate 24, side portion 26, lower support 28 and upper support 30 are made of a solid integral block of metal in this embodiment.

Within suitable bores 34 and 36 in lower and upper supports 28 and 30, there are mounted lower and upper roller drive shafts 38 and 40. The roller drive shafts 38 and 40 run in suitable inner bearings (not shown) and outer bearings (not shown) mounted in the free ends of lower and upper supports.

The two shafts 38 and 40 extend out through the side body 26, and are connected for co-rotation in opposite directions by means of lower and upper gears 50 and 52 meshing together.

A drive train comprising a motor 54 and a clutch or brake mechanism 56 are connected in this case to the upper shaft 40. The motor or brake mechanism are illustrated merely as blocks, since they are generally well know in the art and require no special description. Adjustable clamps 58 key gears 50 and 52 to their respective shafts 38 and 40.

On the cantilever ends of shafts 38 and 40 remote from the side body 26, the ends of the shafts extend outwardly relative the lower and upper supports 28 and 30. On the free ends of the lower and upper shafts, there are mounted lower and upper rotary die assemblies 60 and 62.

The respective lower and upper rotary die assemblies 60 and 62 are keyed to the free ends of their shafts 38 and 40 by any suitable means known in the art. Outwardly of the rotary die assemblies 60 and 62, there are provided lower and upper cam support plates 64 and 66, secured on the outer ends of lower and upper bodies 28 and 30 respectively.

Referring now to FIGS. 2 and 9 to 18, it will be seen that in this illustrated embodiment, although without restriction, there are shown two sets of four punch dies on the upper rotary die assembly 62 and two sets of two die recesses on the lower rotary die assembly 60.

As will be seen from the schematic illustration of FIGS. 3 and 4, in this particular embodiment, the web W is shown as being made with a shorter round opening 12 and a longer elongate opening 14 and, the elongate opening 14 being located down stream relative to the round opening 12. Thus as the web passes from left to right (FIG. 1) and the round opening 12 is made first and the elongate opening 14 is made next. The order of the openings could readily be reversed. This explanation is for illustration only.

Figure 9:
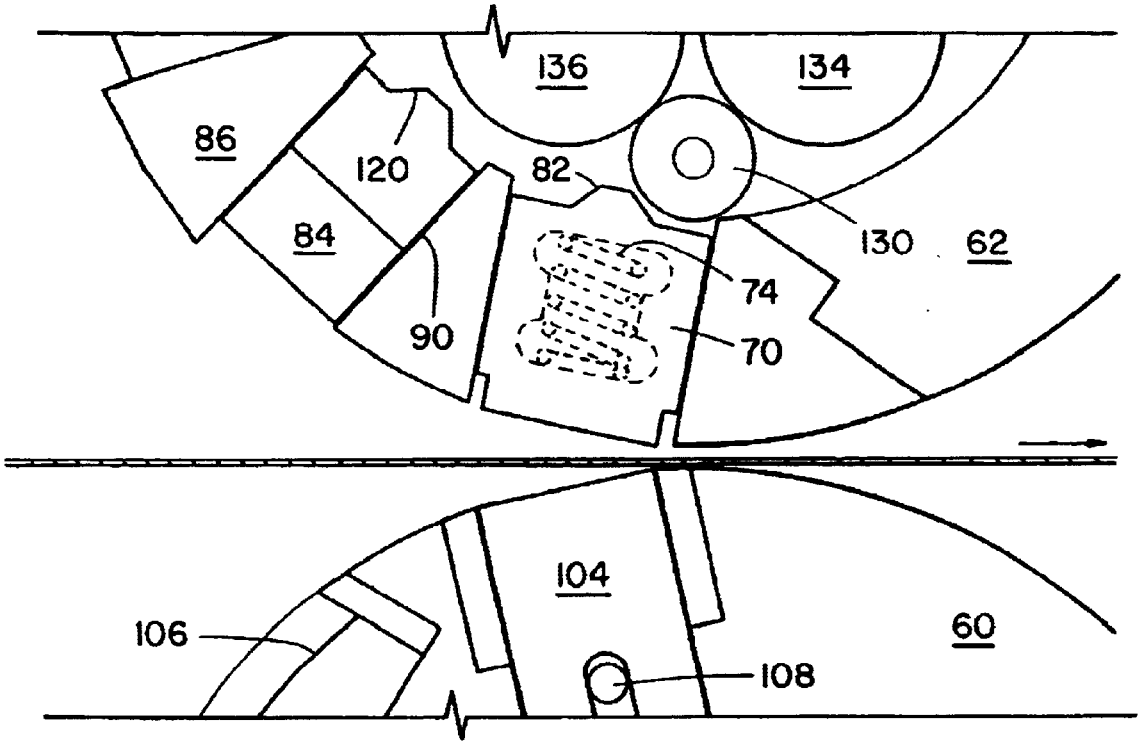
FIG. 9 is a schematic view corresponding to FIGS. 4 and 5 showing the punching of a separate short opening by a hole punch die at a fourth rotary position of the apparatus.
Figure 10:
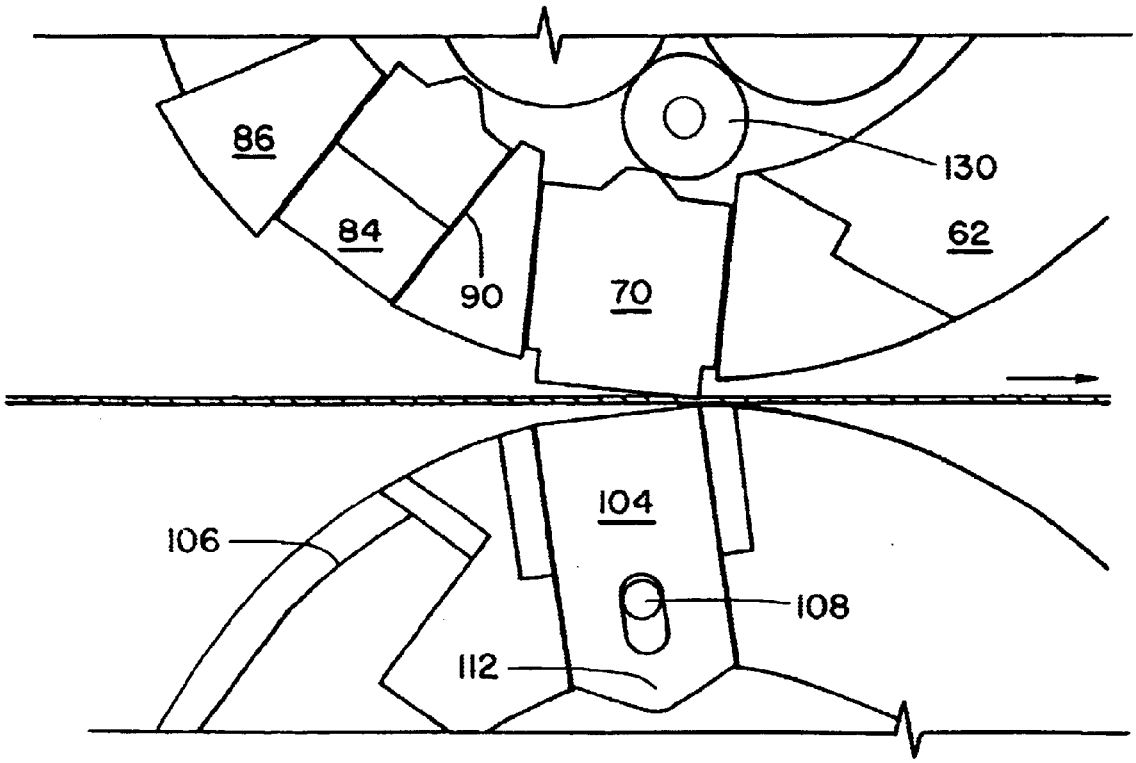
FIGS. 10, 11 and 12 show further positions for punching the short openings.
Figure 11:
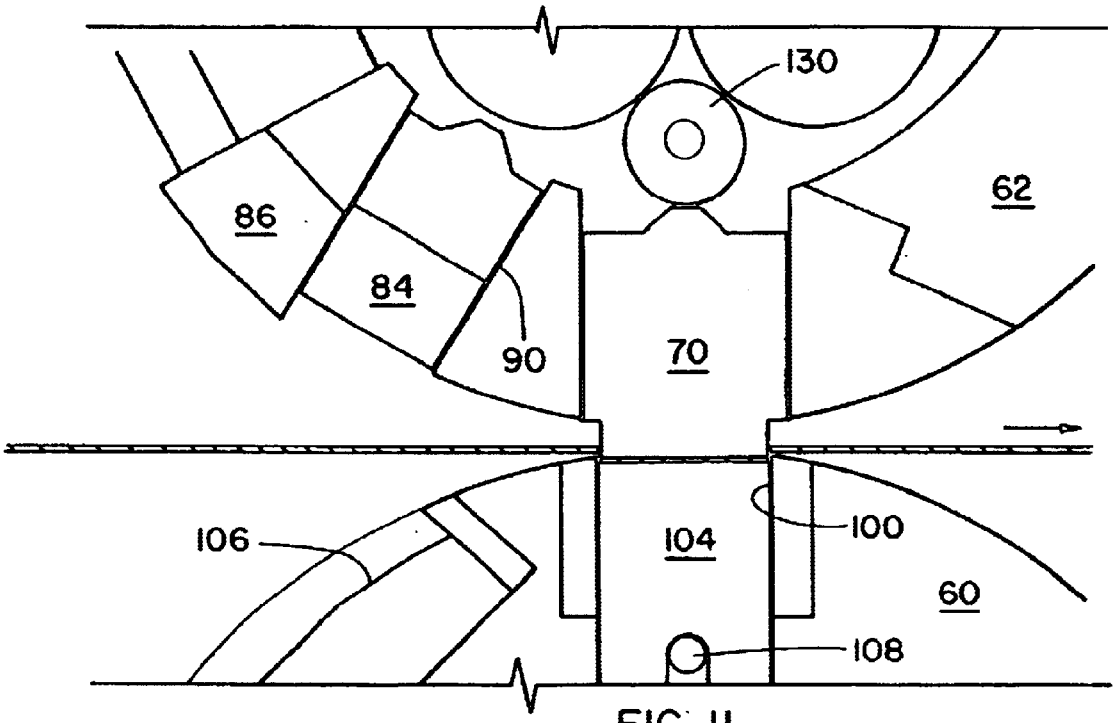
Figure 12:
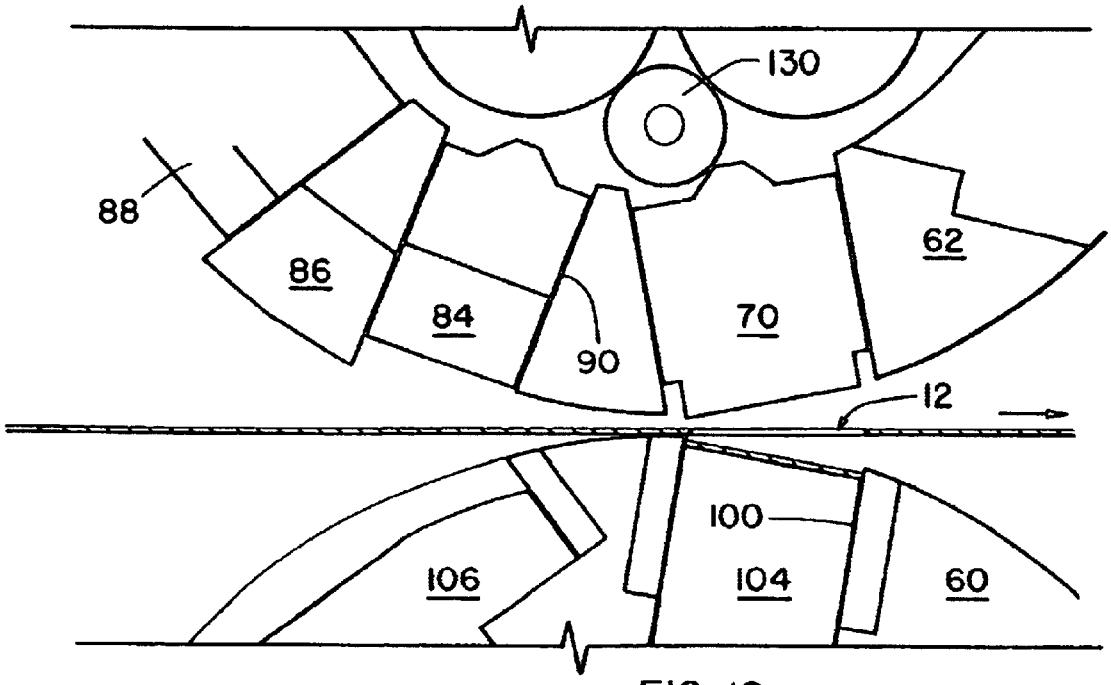

In order to punch the opening 12, which in this case is shorter than the opening 14, hole punch dies 70, are provided, spaced radially around the circumference of the upper die assembly 62. Hole punch dies 70 are slidably received in suitable generally radial bores 72 in the upper die assembly 62, and are normally urged inwardly by spring means 74 (FIG. 9).

Figure 5:
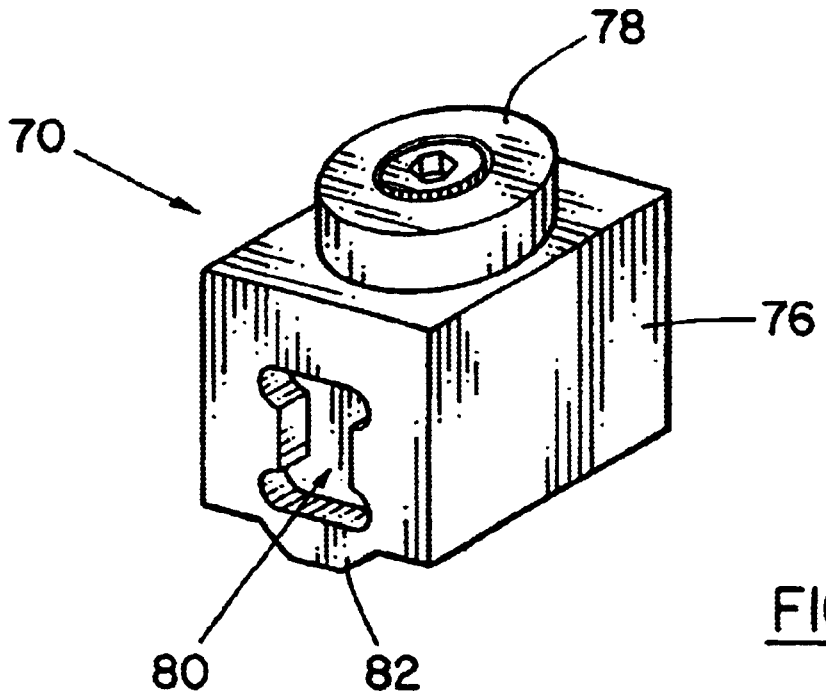
FIG. 5 is a perspective illustration of a punch die.

The hole punch die 70 is shown in isolation in FIG. [[5.]] In this figure, the hole punch die is shown in isolation in FIG. 5. It comprises a die body 76 of generally rectangular shape, and having a cutting die boss 78, shaped to cut out an opening, in this case, a circular opening 12, from the web.

Within die body 76 there is provided a spring recess 80. At the opposite end of die body 76 there is provided a cam follower profile 82, the purpose of which will be described below.

The elongate opening 14 in the web is punched out by a leading moveable punch die 84, and a median fixed punch die 86 and a trailing moveable punch die 88. All of dies 84, 86 and 88 are mounted in the upper rotary die assembly 62.

Reference to FIGS. 9 to 18 will illustrate the progression of the positions of the upper and the lower die assemblies 62 and 60, with the web moving from left to right in the illustrations, merely for the sake of example and illustration.

The leading moveable die 84 is mounted in a generally radial cavity 90 within the upper rotary die assembly 62, and is moveable outwardly and is normally biased inwardly by suitable die spring means (not shown). Such die springs are in general terms well known in the art, although their use in this particular application and in a rotary die assembly is believed to be unique.

The cavity 90 is not truly radial. The axis of the cavity is offset relative to a true radius of the upper die assembly 62, by an angle in the region of 5 degrees so as to provide a more rapid and complete punching action, in a manner to be described below.

The median die 86 is a fixed die body mounted in the upper rotary die assembly 62, adjacent to the leading moveable die 84.

The trailing moveable die 88 is moveably mounted in a generally radial cavity within the upper die assembly 62 and is moveable outwardly therefrom and is normally urged inwardly by suitable die spring means (not shown) such as are well known in the art.

The upper die assembly 62 itself will be seen to define an interior circular or cylindrical recess 92, and the upper die assembly 62 will be seen to define two semi-segmental die portions 62*a* and 62*b* having a generally annular periphery.

Lower die assembly 60 will be seen to comprise a similar shape namely defining an interior circular or cylindrical recess 94, and the exterior shape being defined by two semi-segmental die portions 60a and 60b each having a generally annular periphery.

The leading, median and trailing dies 84, 86 and 88 together co-operate to punch the elongate opening 14 illustrated generally in web W (FIG. 3). Opening 14 defines a generally linear leading edge 14*a*, side edges 14*b*, and a generally triangular trailing edge 14*c*. The function of the leading die 84 is to punch the leading linear edge 14*a* and commence punching of the two linear side edges 14*b*.

The function of the median die 86 is to continue punching the two linear side edges 14*b*.

The function of the trailing die 88 is to punch the two generally triangular edges 14*c* of the trailing portion of the elongate opening 14.

The combination of the leading and trailing dies 84 and 88 which are moveable, to provide a punching or piercing action, together with the intermediate leading die 86 is such as to punch the elongate opening, for example, in the shape illustrated at FIG. 3, with repeatability and great precision. The precise shape of the elongate opening will, of course, be defined by the profiles of the dies themselves, and may be widely varied depending upon the shape of the opening to be punched out, or alternatively the shape of the portion of the web which is desired to separate from the web itself.

Co-operating with the dies 80, and 84, 86 and 88 there are provided in the lower die assembly 60 a first complementary die recess 100 and second complementary die recess 102. The first die recess 100 has a shape and arcuate extent corresponding to the hole punch die 80. Recess 102 has an extent equal to dies 84, 86 and 88. Within each recess 100 and 102 there are provided knock-out plates 104 and 106 slidably retained by, for example, pins 108 and 110. The inward surface of the knock-out plates 104 and 106 define cam profiles 112.

Figure 6:
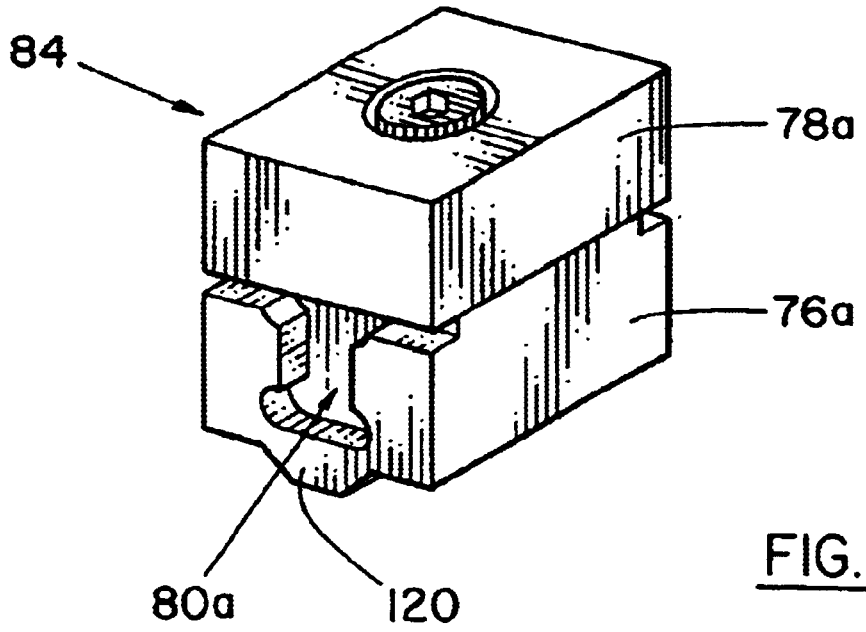
FIG. 6 is a perspective illustration of another punch die.
Figure 8:
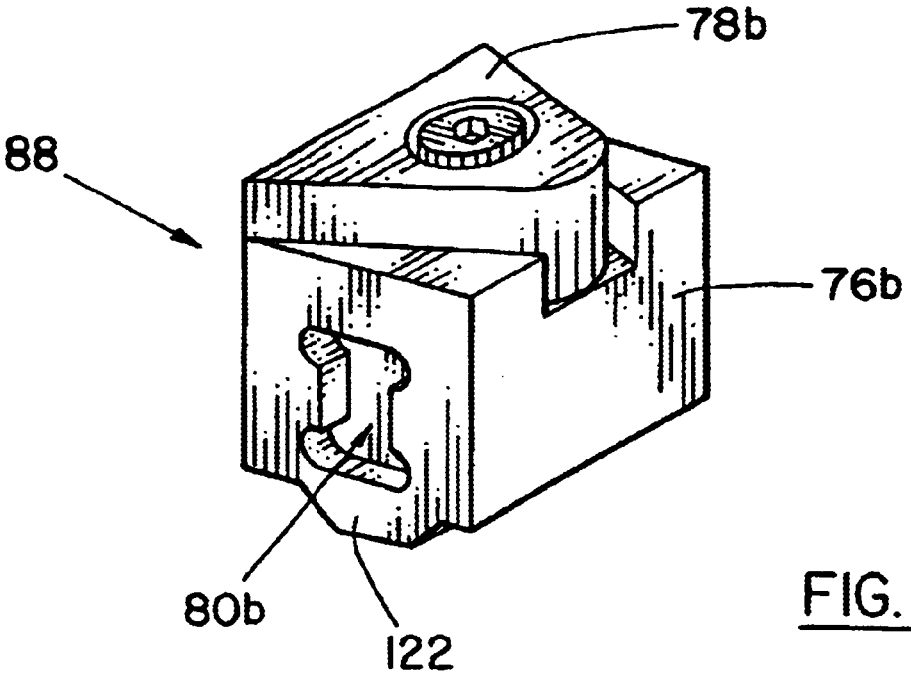
FIG. 8 is a perspective illustration of a trailing punched die.

The leading dies 84 are formed in a generally similar fashion to the hole punch die 70 and are shown in isolation in FIGS. 6 and 8 respectively.

For the sake of simplicity the same reference numbers are used, as in FIG. 5.

Thus the leading dies 84 will be seen to comprise a die body 76*a*, a die boss 78*a*, a spring recess 80*a*.

The trailing dies 88 are formed in a generally similar fashion to the hole punch die 70 and are shown in isolation in FIGS. 6 and 8 respectively.

For the sake of simplicity the same reference numbers are used, as in FIG. 5.

Thus the trailing dies 88 will be seen to comprise a die body 76*b*, a die boss 78*b*, a spring recess 80*b*.

The leading and trailing dies 84 and 88 define on their inward ends cam profiles 120 and 122.

Figure 7:
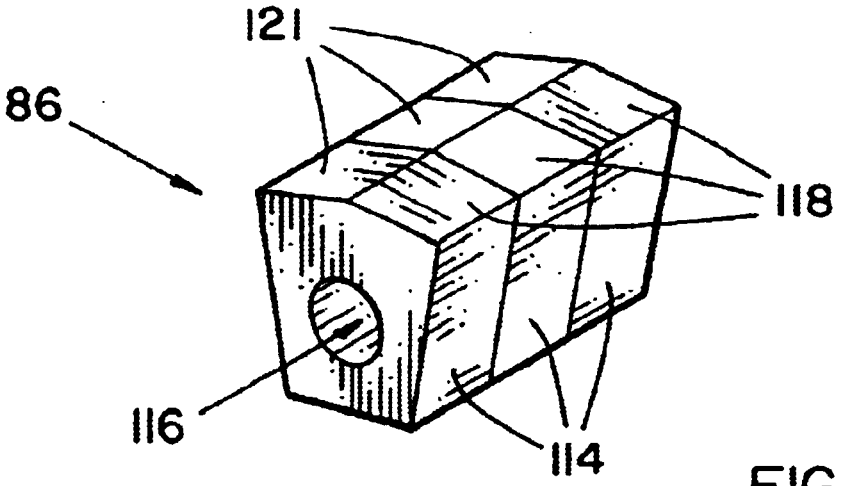
FIG. 7 is a perspective illustration of a fixed intermediate punched die.

The median dies 86 are shown in more detail in isolation in FIG. 7.

They will be seen to comprise a plurality, in this case three, die bodies 114, each of which defines a central through bore 116 by means of which they may be mounted in position.

The bodies 114 define die cutting surfaces 118, and 121. The surfaces 118 are set at a shallow obtuse angle to the surfaces 121, so as to provide a progressive blanking action, in a manner to be described below.

The median dies 86 between dies 84 and 88 is fixed and does not therefore have a cam profile.

Located within cylindrical recess 94 of lower die assembly 60 there is provided a cam means which in this case comprises a roller 124. Roller 124 is rotatably supported on lower cam support plate 64.

Within recess 92 of upper die assembly 62 there is provided a cam means in the form of roller 130 rotatably mounted on upper cam support plate 66 and supported by means of support rolls 134 and 136.

Figure 2:
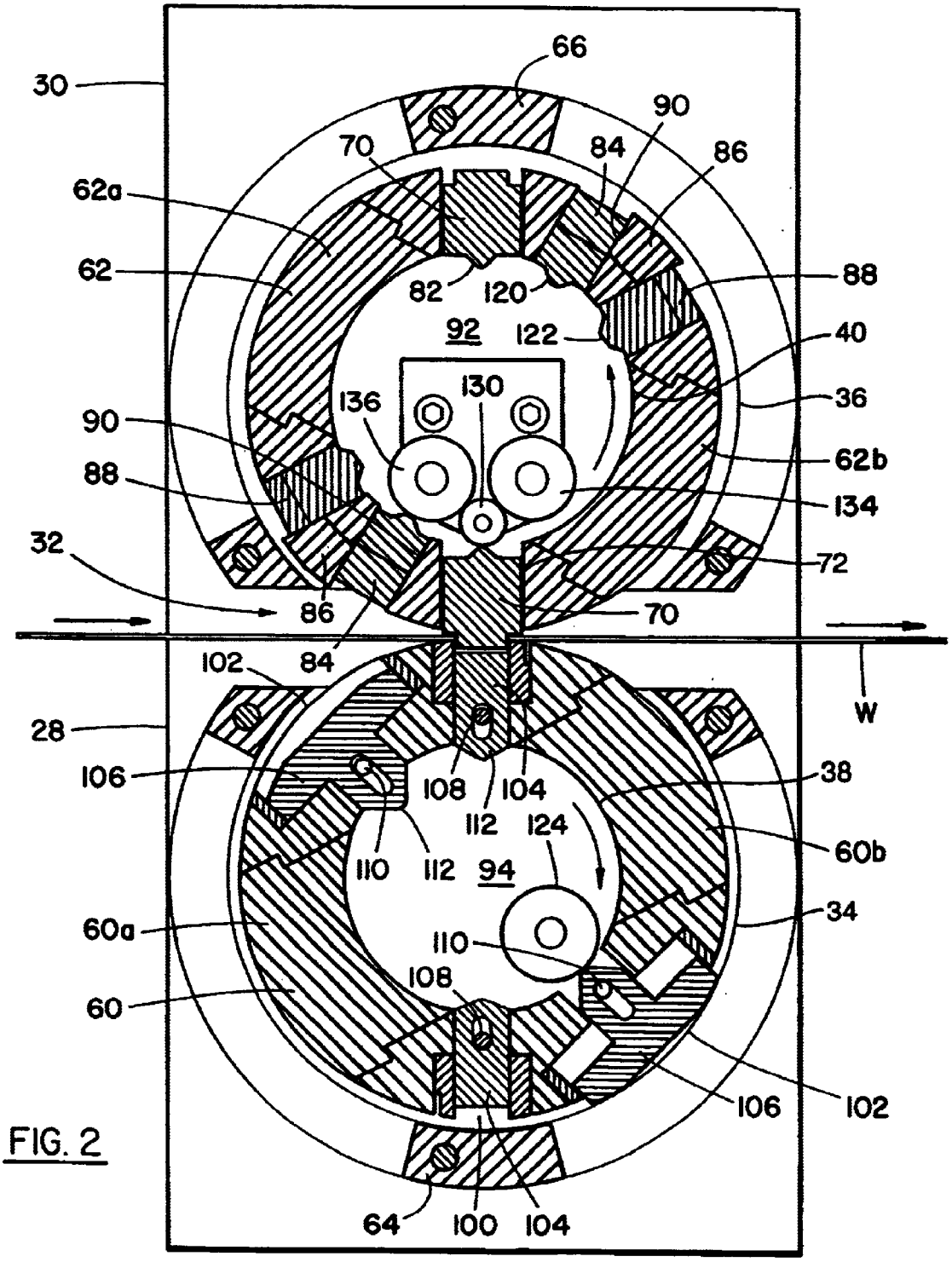
FIG. 2 is a section along the line 2—2 of FIG. 1.

As the lower and upper die assemblies 60 and 62 are rotated by their associated shafts, the lower die assembly 60 will rotate in a clockwise direction (FIG. 2) and the upper die assembly 62 will rotate in a counter clockwise direction (FIG. 2).

It will be appreciated that the reference to clockwise and counter clockwise is without limitation and is merely by way of explanation of what is shown in the drawings. That the two rolls simply co-rotate in opposite directions, and it is believed that it is self evident from the drawings. They could be designed to co-rotate in the other direction.

As the two die assemblies rotate one half of a complete revolution, they will progressively move through the die positions illustrated in FIGS. 9 to 18.

In FIGS. 9 to 12 the hole punch die 80 is punching the web W. The inboard cam profile 82 of the die 80 is engaging the roll, so as to force the die 80 downwardly through web W. In this position, the die recess 100 (in lower assembly 62) is registering with die 80 and will receive the struck out portion from the opening 12 in the web.

FIGS. 9, 10, 11 and 12 show the progressive positions of the hole punch 80, and its respective die recess 100.

Once the hole punch 80 is withdrawn from the opening it has punched in the web, the lower and upper die assemblies 60 and 62 will continue to rotate to the positions shown progressively in FIGS. 13 to 18.

Figure 13:
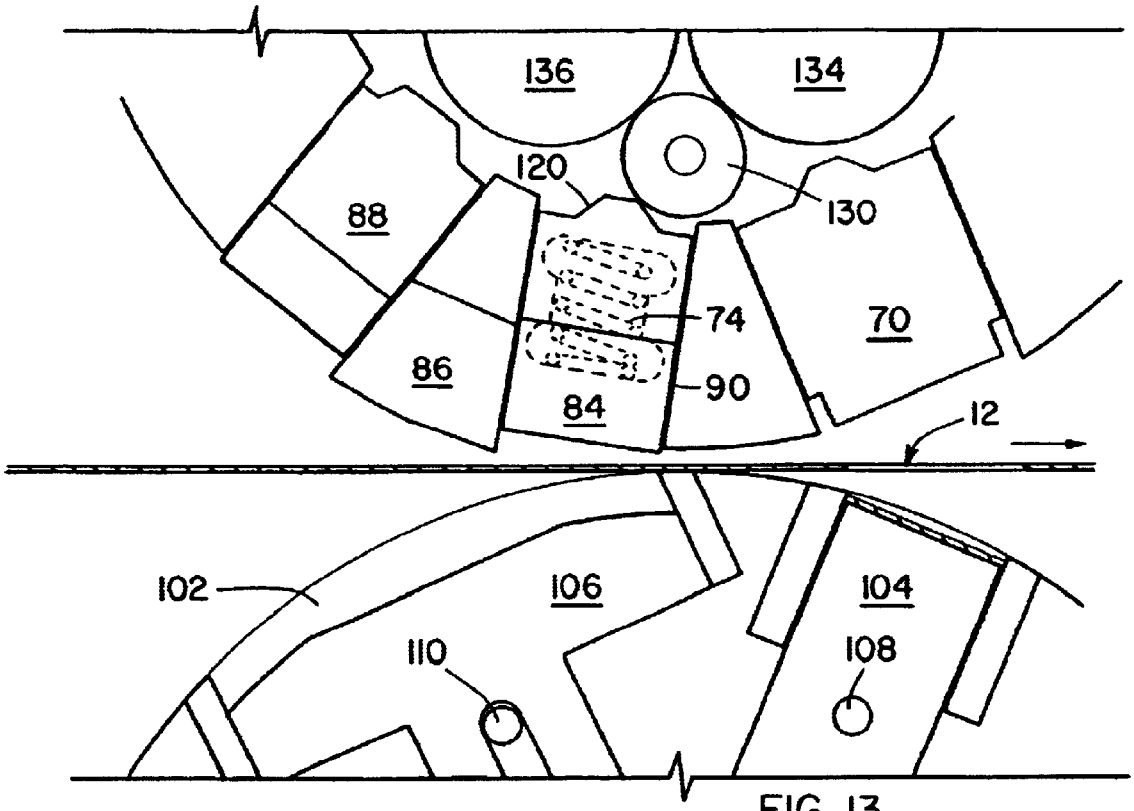
FIG. 13 is schematic view corresponding to FIG. 3 showing the punching of an elongated opening by a lead die, at a leading rotary position of the apparatus; and, FIGS. 14, 15, 16, 17 and 18 show further positions for punching the elongate openings.
Figure 14:
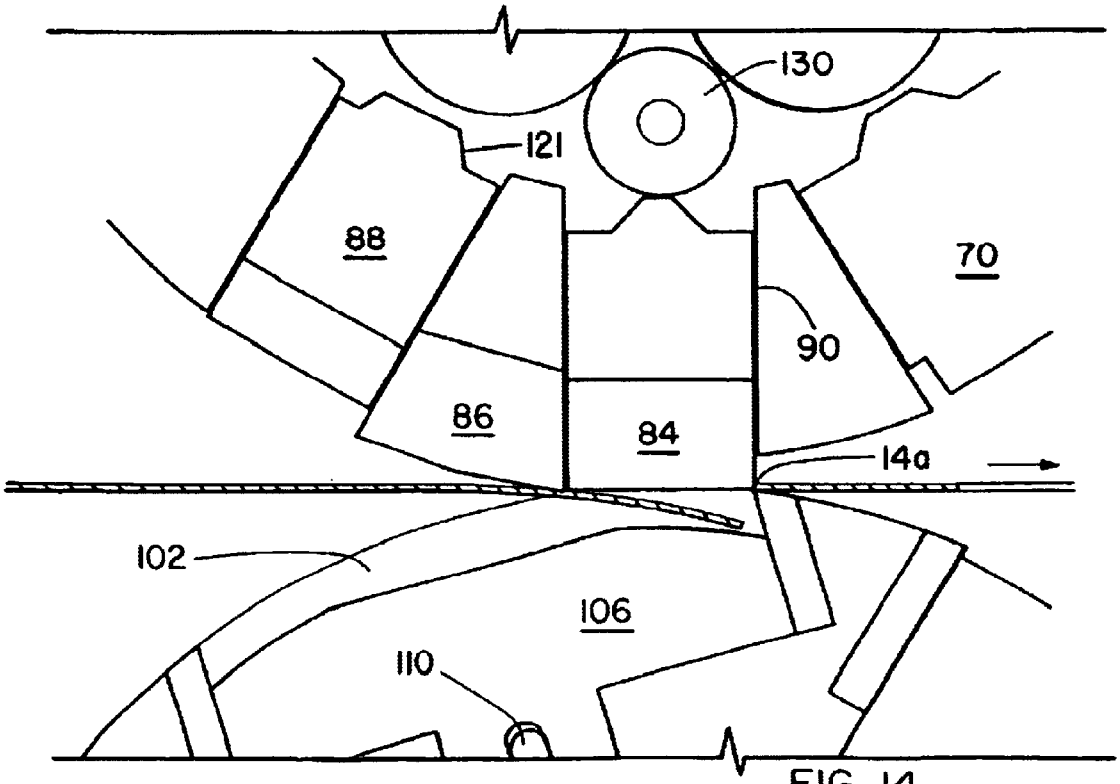

In FIG. 13 the leading die 84 is engaging the web W and its cam profile 82*a* is engaging the cam roller 130. The lower die assembly 60 is located with its recess 102 registering with the die 80.

Figure 15:
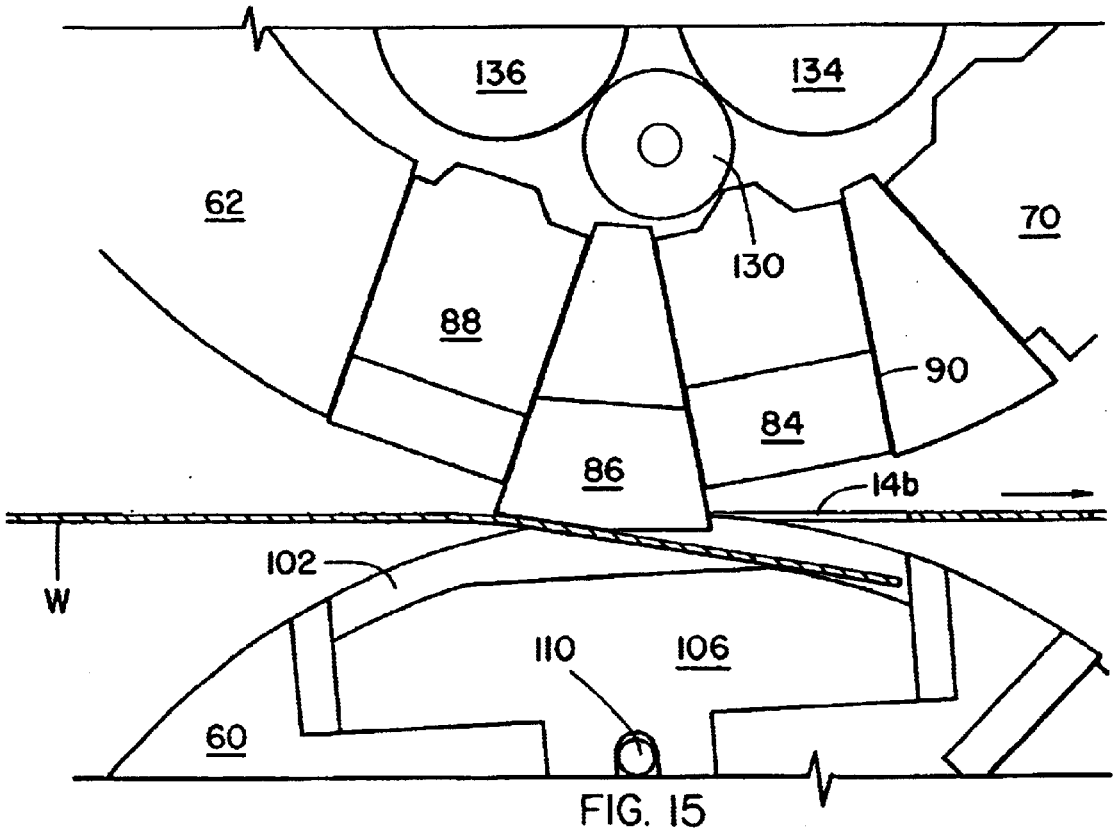
Figure 16:
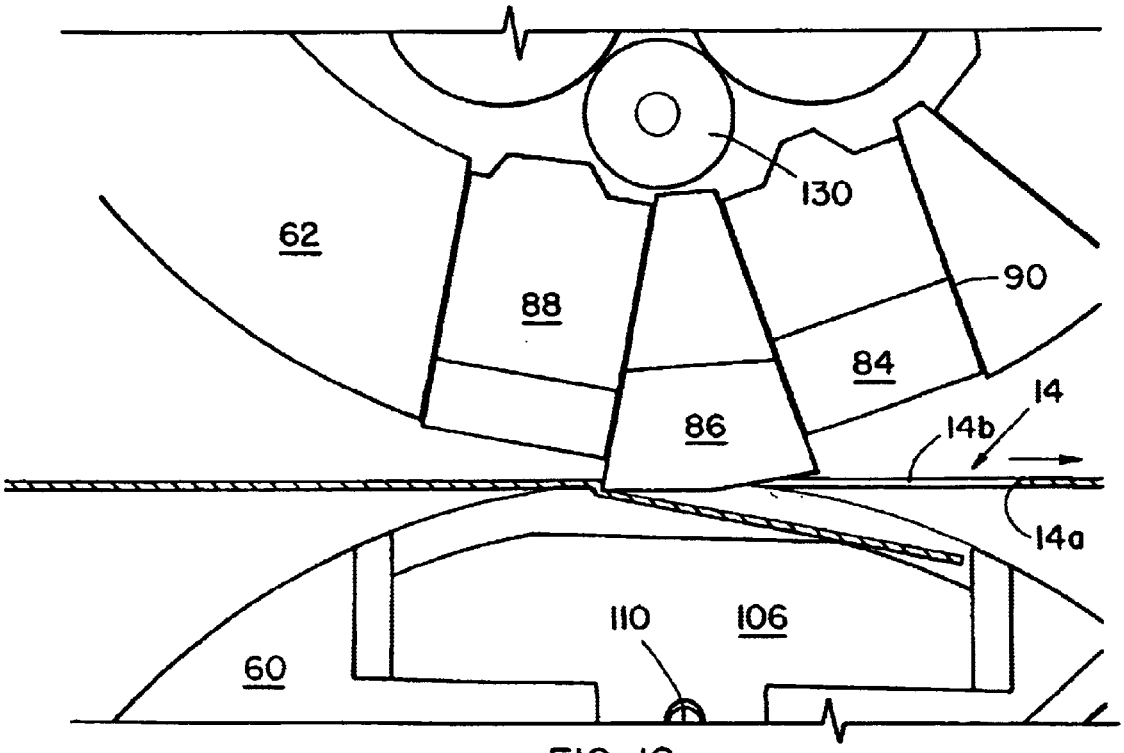

In the FIG. 15 position the median die 86 is engaging the web W at the trailing portion from the he leading die opening and the lower die assembly 60 has rotated so that the central portion of the recess 102 is registering with the die 86.

Figure 17:
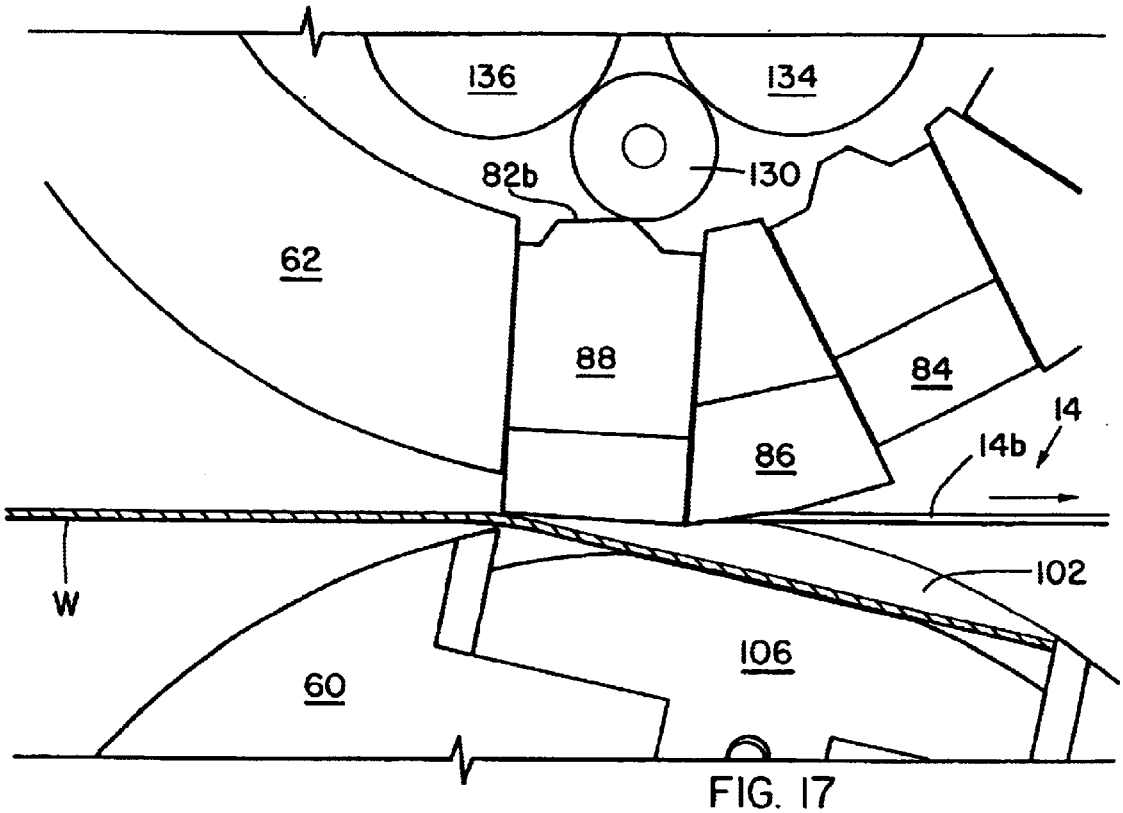
Figure 18:
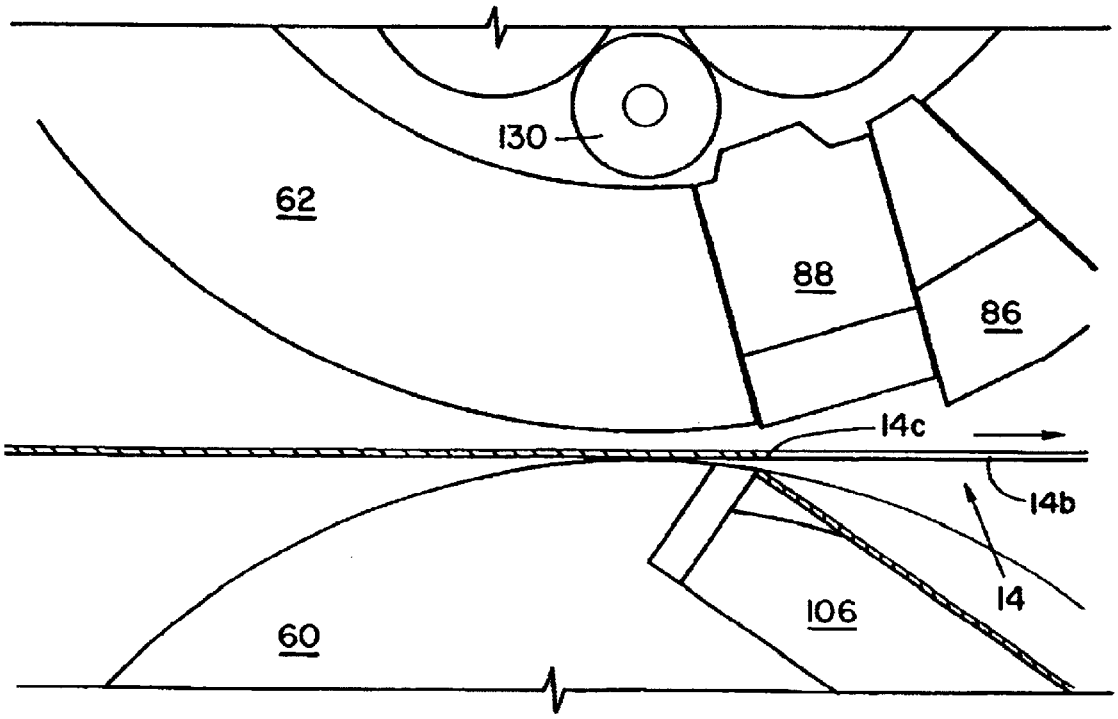

In the FIG. 17 position, the trailing die 88 is engaging the web. The die cam profile 82*b* is engaging the roller 130 and the die is thus punching the web W to punch the trailing edge of the opening 14.

The lower assembly 60 has also rotated an arcuate distance corresponding to the upper assembly and, in this case, the trailing end of the recess 102 is registering with the trailing die 88.

Once the four dies have performed their operations on the web, the assemblies 60 and 62 will then rotate until the arcuate surfaces 60*b*, 62*b* are on opposite sides of the web. In this position, the dies will be inactive. The two knock-out plates 104 and 106 will also have engaged in succession the roller 124 thereby ejecting the portions of the web which have been removed by the dies.

The clutch or brake 56 is then operated to halt further rotation so as to permit the web to continue to pass between the assemblies so as to leave a portion of the web free of openings.

When it is again desired to punch openings in the web the clutch or brake 56 is then operated so as to once again engage motor 54 and drive the shafts and thereby the lower and upper die assemblies so as to perform the functions described above.

It will be appreciated that in the embodiment as illustrated, there are two sets of dies, on opposite sides of the upper die assembly 62 and two sets of openings on opposite sides of the lower die assembly 60. Thus, the arcuate extent of the actual operation of each of the die assemblies, required to punch out the short openings and the elongated openings, is only about 90 degrees more or less, and the upper and lower assemblies will be at rest for an arcuate extent of approximately 90 degrees, until they are again reactivated.

Thus the entire apparatus can be started and stopped with great rapidity, so that short and long holes can be punched in the web even when the web is moving at great speed, and the spacing between the sets of short and long openings can be varied from one production run to the next, so as to suit the customers requirements.

It will, of course, be appreciated that the timing of the operation of the rolls will vary depending upon such factors as, for example, the speed at which the web is moving, the diameter of the lower and upper die assemblies, and the spacing required between the openings.

It will also be appreciated that in some cases only one such opening will be required, in which case one or some of the dies can simply be removed from the rolls.

Changes in the profile of the openings can easily be effected by simply removing the die assemblies and replacing them with other die assemblies.

The entire operation of the apparatus can be controlled, for example, by means of any suitable web sensing mechanism such as a measuring device typically being incorporated in the apparatus 10. The sensing apparatus not shown may be connected to a suitable computer console 140 which is in turn connected to operate the motor 54 or the clutch/brake 56, depending upon the way in which the apparatus is being operated.

By the use of the invention, it is found possible to punch holes in a web moving at high speed, in metal gauges of widely varying thickness, going from the thinnest gauge practical, up to at least 12 gauge, without unduly stressing the apparatus.

While in this embodiment of the invention, the mounting in arrangement of the lower and upper die assemblies, is shown to be in a generally cantilever fashion, it will be appreciated that without departing from the scope of the invention, such lower and upper die assemblies could be rotatably mounted between die stands on opposite sides of the web, if that arrangement was found to be desirable.

The mounting and arrangement of such die assemblies in stands on opposite sides of a web is not believed to require any special description.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A rotary punching apparatus for punching elongate openings in a moving web workpiece the elongate openings having a predetermined length along the longitudinal axis of the web and comprising;

two die assemblies located on opposite sides of the path of the web workpiece, and power means for rotating the assemblies;

a first die mounted on one said assembly of said assemblies, and movement means for moving said first die generally outwardly relative to said one assembly so as to punch a first die opening through said web;

a second die on said one assembly adjacent to said leading die, said second die being located to engage and punch the web whereby to punch a continuation of said first die opening in said web, thereby defining a continuous opening, and;

a third die cooperating with said first and said second dies, whereby to pierce said web and further define and expand said continuous opening.

2. A rotary punching apparatus for punching elongate openings in a moving web workpiece the elongate openings having a predetermined length along the longitudinal axis of the web and comprising;

two die assemblies located on opposite sides of the path of the web workpiece, and power means for rotating the assemblies;

at least a leading die mounted on one said assembly of said assemblies, and movement means for moving said leading die generally outwardly relative to said one assembly so as to punch a first die opening through said web;

a trailing die on said one assembly adjacent to said leading die, said trailing die being located to engage and punch the web whereby to punch a continuation of said first die opening in said web, thereby defining a continuous opening which is elongated along the axis of the web, having a predetermined length along said longitudinal axis of said web and;

a die recess in the other of said assemblies registering with said leading and trailing dies.

3. A rotary punching apparatus as claimed in claim 2 in which said trailing die operates to continue and to extend said first die opening.

4. A rotary punching apparatus as claimed in claim 2 wherein the assemblies are mounted in a cantilever fashion in a stand located along one side edge only, of the web path, the assemblies being long enough to extend partly across the web to locate the dies along the desired piercing axis of the web.

5. A rotary punching apparatus as claimed in claim 2 including leading die operating cam means, in said one assembly the leading die extending into said assembly and terminating in cam follower means located to be engaged by the cam means.

6. A rotary punching apparatus as claimed in claim 2 including trailing die operating cam means in said one assembly, the trailing die extending into the assembly and terminating in cam follower means located to be engaged by the cam means.

7. A rotary punching apparatus as claimed in claim 2, and wherein there are two sets of said leading and trailing dies, mounted at spaced locations around said one die assembly, and wherein there are at least two sets of said die recesses, registering with respective said sets of said leading and trailing dies.

8. A rotary punching apparatus as claimed in claim 2, and including a second hole punch die, and a second hole punch recess, registering therewith.

9. A rotary punching apparatus as claimed in claim 2, and including at least one recess in said one of said assemblies, for slidably receiving said leading die, said at least one recess being located along an axis which is off set relative to a radius of said at least one said assembly.

10. A rotary punching apparatus as claimed in claim 2 including a third die cooperating with said leading and trailing dies, whereby to pierce said web and further define said continuous opening.

11. A rotary punching apparatus as claimed in claim 10, and wherein said third die is fixed to said one of said assemblies, and wherein said third die defines two punching surfaces, said punching surfaces being located at an obtuse angle to one another.

12. A rotary punching apparatus as claimed in claim 2 including a hole punch die moveable radially relative to said assembly operable to punch a further opening in the web spaced axially along the longitudinal axis of the web from said elongate opening punched by the leading and trailing dies, and a hole punch die recess in said other assembly.

13. A rotary punching apparatus as claimed in claim 12, including hole punch die operating cam means in said one assembly, the hole punch die extending into the assembly and terminating in cam follower means located to be engaged by the cam means.

14. A rotary punching apparatus as claimed in claim 2 and including knock out means to eject the struck out web portions from the recesses in said other of said assemblies.

15. A rotary punching apparatus as claimed in claim 14, wherein said knock out means are movable in a generally radial fashion relative to said other of said die assemblies, and including means for moving said knock out means.

16. A rotary punching apparatus as claimed in claim 1 and including power operated means for rotating said die assemblies, the power operated means being operable intermittently so as to punch the openings at desired longitudinal spacings along the axis of the web, and whereby the assemblies are held stationary where openings are not required so as to permit the web to pass between the assemblies without openings being punched.

17. A rotary punching apparatus as claimed in claim 16 wherein the power operated means comprises an intermittently operable motor.

18. A rotary punching apparatus as claimed in claim 17, and further including intermittently operable clutch means, whereby to disconnect said power operated means from said die assemblies.

19. The method of punching an elongate opening in a continuously moving web work piece and comprising the steps of passing said web work piece between a pair of rotary die assemblies, one of said die assemblies carrying a leading movable die, and a trailing movable die adjacent to one another, said leading and trailing movable dies being movable upon rotation of said one of said assembly, whereby to move sequentially outwardly from said assembly, and punch said web work piece, said leading die punching a leading edge of said elongate opening, and said trailing die cooperating with said leading die to continue said elongate opening, and said leading and trailing dies punching side edges of said elongate opening between said leading and trailing edges.

20. The method as claimed in claim 19, including the step of punching said web work piece by means of third die means cooperating with said leading and trailing dies, whereby to pierce said web and further define said elongate opening.

21. The method as claimed in claim 20, including a step of further punching a further opening in said web work piece, by means of a hole punch die spaced from said leading and trailing die, whereby to punch said web work piece with two spaced apart openings.

* * * * *